US005822799A

United States Patent [19]

Kepple

[11] Patent Number: 5,822,799

[45] Date of Patent: Oct. 20, 1998

[54] SWEATING FOR HEAD COVERING AND METHOD FOR MANUFACTURING

[75] Inventor: Jeffrey L. Kepple, Denver, Pa.

[73] Assignee: Bollman Hat Company, Adamstown, Pa.

[21] Appl. No.: 734,457

[22] Filed: Oct. 17, 1996

[51] Int. Cl.[6] ..... A42B 1/22

[52] U.S. Cl. ..... 2/183; 2/181; 2/184; 2/DIG. 11

[58] Field of Search ..... 2/183, 175.1, 181, 2/184, 195.3, 417, 418, DIG. 11

[56] References Cited

U.S. PATENT DOCUMENTS

| | | | |
|---|---|---|---|
| 238,865 | 3/1881 | Davis . | |
| 480,041 | 8/1892 | Schlesinger . | |
| 1,097,255 | 5/1914 | Muhlfeld . | |
| 1,144,462 | 6/1915 | Cohen . | |
| 1,393,652 | 10/1921 | Van Huele . | |
| 1,486,776 | 3/1924 | McKnight . | |
| 1,511,129 | 10/1924 | McKnight . | |
| 1,674,361 | 6/1928 | Gstalder | 2/183 |
| 2,092,808 | 9/1937 | Lipton . | |
| 3,309,713 | 3/1967 | Kaufman . | |
| 3,487,472 | 1/1970 | Lewtan . | |
| 5,632,046 | 5/1997 | Green et al. | 2/183 |

FOREIGN PATENT DOCUMENTS

| | | | |
|---|---|---|---|
| 1442333 | 7/1976 | United Kingdom | 2/183 |

*Primary Examiner*—Diana Biefeld

*Attorney, Agent, or Firm*—Shlesinger, Arkwright & Garvey LLP

[57] ABSTRACT

A sweatband for a head covering comprising an elastic tape, a non-elastic ribbon, an attachment member to attach the tape T to an attachment section of the ribbon R while the tape is in a stretched condition and a connecter to connect a connection section of the ribbon to an interior wall of the head covering. A method of making and installing the sweatband in a head covering.

34 Claims, 3 Drawing Sheets

SWEATING FOR HEAD COVERING AND METHOD FOR MANUFACTURING

FIELD OF THE INVENTION

This invention relates generally to sweatbands for head coverings and more particularly to non-adjustable sweatbands in which an elastic means is used so a headpiece can be worn comfortably by persons of different head sizes and varying head contours.

BACKGROUND OF THE INVENTION

In the past, there have been numerous attempts to make headpiece (or head cover) sweatbands that are versatile so as to fit a variety of head sizes and to provide comfort as well as support to keep the headpiece on the head. However, these attempts have not all succeeded in providing the necessary comfort, support, ease of installation, low manufacture cost and user-free adjustment.

Many patents have been granted to provide features for adjusting the sweatband size, such as Muhlfeld U.S. Pat. No. 1,097,255; Cohen U.S. Pat. No. 1,144,462; Van Huele U.S. Pat. No. 1,393,652; McKnight U.S. Pat. Nos. 1,486,776 and 1,511,129; and Lipton U.S. Pat. No. 2,092,808.

There have also been many other patents that have been granted to attempt to provide the aforementioned features such as: Davis U.S. Pat. No. 238,865; Schlesinger U.S. Pat. No. 480,041; Kaufman U.S. Pat. No. 3,309,713; and, Lewtan U.S. Pat. No. 3,487,472.

OBJECTS AND SUMMARY OF THE INVENTION

It is an object of the present invention to provide an improved sweatband for headpieces which will comfortably fit varying head sizes.

Yet another object of this invention is to provide a sweatband for a headpiece which will conform to the contours of the users head.

Still a further object of this invention is to provide a sweatband for headpieces which will require no adjustments or tying of the elastic band by the user, or wearer.

Yet another object of this invention is to provide a sweatband for a headpiece which will maintain a comfortable snug fit on the user, or wearer.

Still a further object of this invention is to provide a sweatband for a headpiece that will not leave an imprint or mark in the skin of wearer's head when the headpiece is removed after being worn for sometime.

Yet another object of this invention is to provide a sweatband for headpiece which is economical to manufacture.

Still a further object of this invention is to provide a method for which the novel sweatband can be easily manufactured and connected with a headpiece.

In summary, the present invention discloses a novel configuration for a headpiece sweatband which includes a means for attaching an elastic tape in a stretched condition to a ribbon, and for a method of manufacturing and installing such a comfort-fit sweatband. These and other objects of the invention will be apparent from the following:

DETAILED DESCRIPTION OF THE INVENTION

Figure 1:
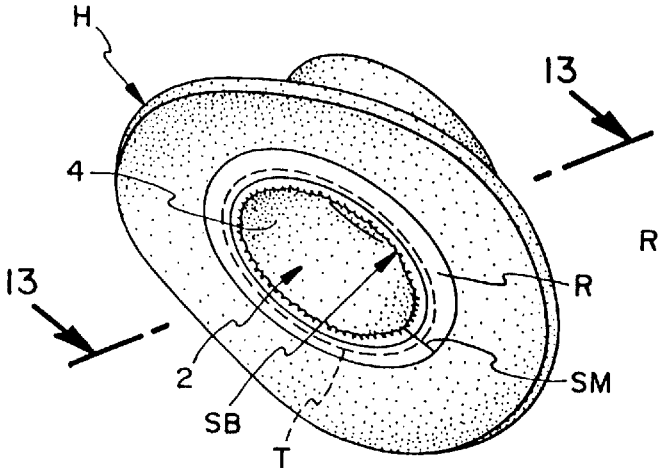
FIG. 1 is an isometric view of this novel sweatband attached to the headpiece.

In FIG. 1, the headpiece H can be of many forms such as: a cowboy hat, a ball cap, a hard hat or any other type of headpiece or head covering. Regardless of the form of the headpiece, the headpiece will have an opening 2 and an interior wall 4. Note, in the case of a hard hat, the interior wall would be the interior portion of the suspension mounted inside the hard hat. Note also, the opening simply refers to where the user's, or wearer's, head would enter the headpiece. Thus, the headpiece could actually have two or more openings.

The sweatband SB is comprised of a ribbon R and a tape T, as will be discussed below. The securing member SM will also be discussed further below.

FIGS. 2–7: METHOD OF MANUFACTURING THE SWEATBAND SB

Figure 2:
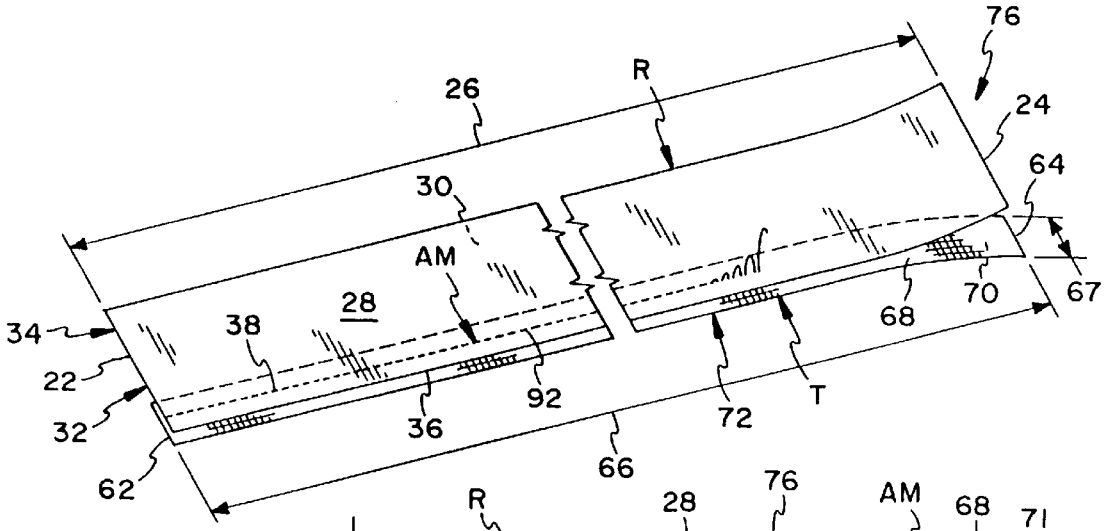
FIG. 2 is an isometric view of the tape in a position relative to the ribbon with the attachment member attaching the tape to the ribbon.
Figure 3:
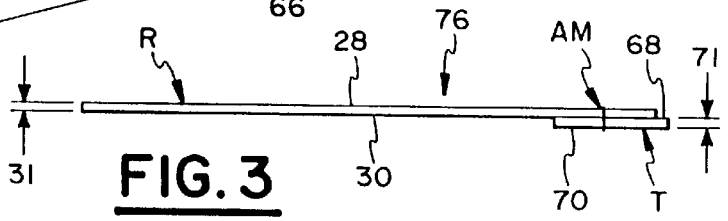
FIG. 3 is an exploded left end view of the tape-ribbon position relationship shown in FIG. 2.

Referring now to FIGS. 2 and 3, the ribbon R and tape T are shown. Note, FIG. 3 is an exploded left end view of tape-ribbon relationship shown in FIG. 2. The ribbon R is preferably made of a comfortable and substantially non-elastic fabric. Although, any material may be used so long as it is non-elastic and is comfortable for the user when the headpiece H is worn. The ribbon R has a first end 22 and a second end 24. Between the first end 22 and the second end 24 there is a determined linear ribbon-length 26. This ribbon-length 26 will generally be based on and slightly longer than the perimeter measurement of the headpiece's H opening 4 (please refer to FIG. 1).

For example, to fit the opening of a headpiece with a standard head size of 7⅜, a ribbon-length 26 of about 24½ inches will be required. Note, this invention will allow a headpiece designed for a large head size to be comfortably worn by users with smaller head sizes. In other words, this invention will allow a headpiece sized at 7⅜ to be worn by adult users with head sizes ranging from about 6⅞ to about 7⅜. The ribbon-length 26 will need to be shorter to fit children sizes and longer to fit larger sizes. For example, the ribbon-length 26 will need to be about 21½ inches long for children head sizes ranging from about 6½ to about 6⅞. For larger head sizes ranging from 7½ to 8, a ribbon-length 26 of about 26.5 inches will be needed.

The ribbon R also has an top surface 28 and a bottom surface 30, as well as a ribbon-thickness 31. The ribbon-thickness 31 is preferred to be about 0.005 inches. The ribbon R is divided along the ribbon-length 26 into two major sections. The first being the attachment section 32. The second, being the connection section 34. There is a first edge 36 along the ribbon-length 26 and the attachment section 32. Within the attachment section 32, there is a first-fold line 38 spanning the ribbon-length 26.

Tape T is made from an elastic material. The tape T has a first end point 62 and a second end point 64 and between the first end point 62 and second end point 64 there is a determined tape-length 66. The tape width 67 is preferred to be about 0.375 inches, for maximum comfort. The tape also has a top side 68 and a bottom side 70, as well as a tape-thickness 71. The tape-thickness 71 is preferred to be about 0.028 inches. It is noted that the ribbon-thickness 31 and the tape-thickness 71 can vary. However, it is preferred that the ribbon to tape thickness ratio not be greater than 6 to 1.

Figure 8:
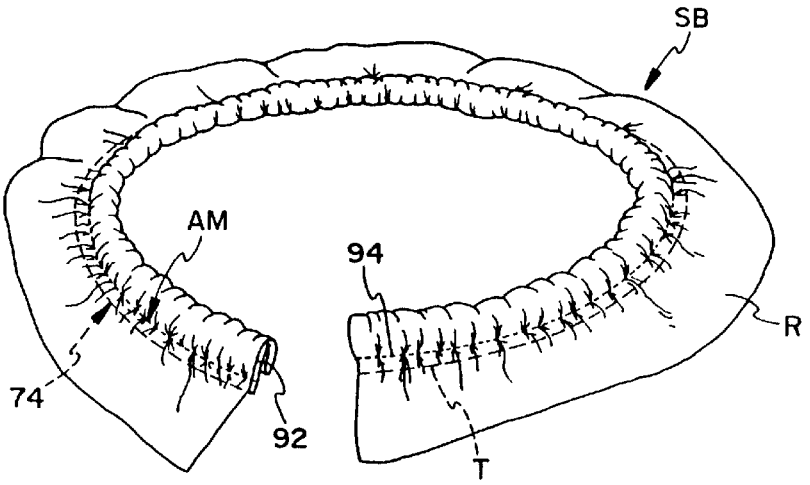
FIG. 8 is a perspective view of the sweatband while the tape is in a relaxed condition.

Tape T, being elastic, can be put in a stretched condition 72. In FIG. 2, the tape T is shown generally in such a stretched condition. Of course, since tape T can have a stretched condition 72, it also has a relaxed condition 74. (Note, the relaxed condition 74 is shown in FIG. 8, not FIG. 2).

The tape-length 66 will, of course, vary in linear measurement depending on the condition of the tape T. While in the relaxed condition 74, the tape-length 66 will be shorter than when in the stretched condition 72. It is preferred, the tape T be able to stretch to a tape-length 66 that is about 25% to 30% greater than the tape-length 66 in the relaxed condition 74.

It is also preferred that while in the relaxed condition 74, the linear measurement of the tape-length 66 be of a lesser value than that of the ribbon-length 26. The length difference is preferred because the elastic tape T is attached to the ribbon R while the tape T is in the stretched condition 72, as will be discussed further below. Accordingly, it is preferred to have a relaxed condition 74 tape-length 66 shorter than the ribbon-length 26, so that when the tape T is in the stretched condition 72, the tape-length 66 is approximately equal to the ribbon-length 26. More particularly, when the ribbon-length 26 is, as discussed above, a length of 24½ inches for adult head sizes ranging from about 6⅞ to about 7⅜, the tape-length 66, for maximum comfort, should be about 19 inches long while in the relaxed condition 74. For childrens' sizes ranging from about 6½ to about 6⅞, the tape length 66 should be about 16 inches long while in the relaxed condition 74 and 21.5 inches long in the stretched condition 72. Furthermore, for the larger head sizes ranging from about 7½ to about 8, the tape-length 66 while in the relaxed condition 74 should be about 21 inches and about 26.5 inches long while in the stretched condition 72.

FIGS. 2 and 3 show the tape T having a position relative to the ribbon R. This position is the tape's T first tape-ribbon position relationship (TRPR) 76. To obtain this first TRPR 76, the ribbon R must be supplied and a tape T must be obtained. Upon acquiring the ribbon R and tape T, they are arranged so that the tape T is substantially parallel to the ribbon R and a portion at the top side 68, of tape T, corresponds with the bottom surface 30 of the attachment section 32 of ribbon R. The top side 68 of the tape T is not completely covered by the ribbon R, when in the first TRPR 76. Also, the tape's T first end point 62 approximately aligns with the ribbon's R first end 22.

While in this first TRPR 76, the tape T is put under tension, to which the tape acquires its stretched condition 72. Then, maintaining both, the first TRPR 76 and the stretched condition, an attachment member AM is employed along the first-fold line 38, so as to attach the tape T to the ribbon R. In the preferred embodiment, the attachment member AM is two series of stitches. More particularly, the attachment member AM has a first series of stitches 92 along the first fold line 38, as shown in FIGS. 2 and 3, and a second series of stitches 94 along the tape-length 66, as described below and shown in FIGS. 6 and 7.

Figure 4:
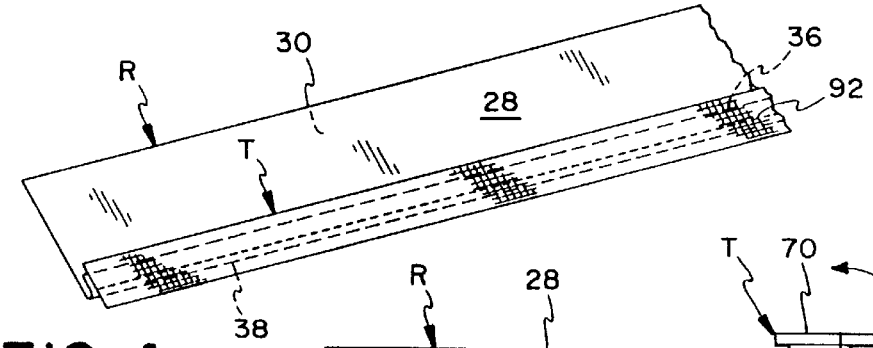
FIG. 4 is an isometric view of the tape in a position relative to the ribbon, where the tape has been rotated 180° from its position in FIG. 2.
Figure 5:
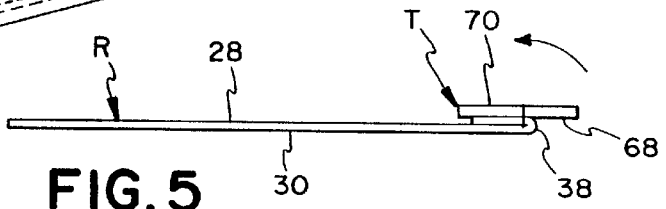
FIG. 5 is an exploded left end view of the tape-ribbon position relationship shown in FIG. 4.

Referring now to FIGS. 4 and 5, the tape T is shown having a position relative to the ribbon R. FIG. 5 is an exploded left end view of the tape-ribbon positioning shown in the isometric view in FIG. 4. Note also, FIGS. 4 and 5 show the tape T in a position rotated, about the first-fold line 38, halfway (180°) between the tape-ribbon positions shown in FIGS. 2 and 6. The directional arrow indicates the direction of rotation.

Figure 6:
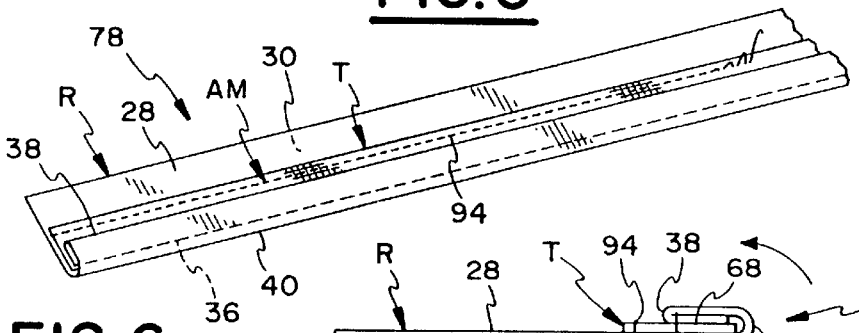
FIG. 6 is an isometric view of the tape in a position relative to the ribbon whereby the tape has been rotated 360° from its relative position in FIG. 2.
Figure 7:
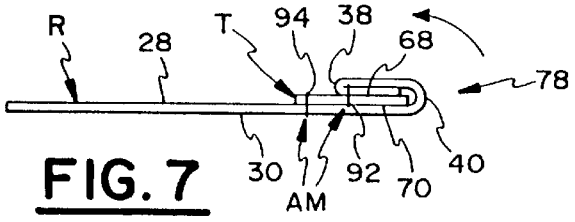
FIG. 7 is an exploded left end view of the tape-ribbon position relationship shown in FIG. 6.

Referring now to FIGS. 6 and 7, the tape T is shown having a position relative to the ribbon R. This position is the tape's T second TRPR 78. Note, FIG. 7 is an exploded left end view of the second TRPR 78 shown in the isometric view in FIG. 6. To obtain this position, the tape T was rotated about 360° along the entire tape-length 66 from the first TRPR 76, in FIGS. 2 and 3, about a second-fold line 40 of ribbon R. In the second TRPR 78 the first edge 36 located between the first-fold line 38 and the second-fold line 40. In this second TRPR 78, the tape T is substantially parallel with the ribbon R and the bottom side 70 of the tape T corresponds with the top surface 28 and in the attachment section 32 of the ribbon R. The directional arrow indicates the direction the tape T was rotated.

While in this second TRPR 78, the tape is again attached to the ribbon R with the attachment member AM, as shown in FIGS. 6 and 7. As aforementioned, in this preferred embodiment, the attachment member AM is two series of stitches and as can be seen in FIGS. 6 and 7, the tape T is being attached along the tape-length 66 to the ribbon R with the second series of stitches 94. Note that prior to attaching, the tape T should be in a stretched condition 72.

FIG. 8

FIG. 8 shows the preferred embodiment of the sweatband SB generally, with the tape T now attached to the ribbon R. In this Figure, tape T is now in a relaxed condition 74. Accordingly, since the tape-length 66 in the relaxed condition 74 is preferably shorter than the ribbon-length 26, as disclosed above, the ribbon R tends to gather (like pleats) in a concave curved linear fashion with the tape T on the inside of the curve.

While the preferred embodiment of the attaching member AM is two series of stitches 92 and 94, it is understood that the attachment member AM could be many other devices such as: at least one or more series of stitches, groups of stitches, gluing, VELCRO (trademark for hook and loop fasteners), stapling, or any other series of two-piece mating systems so long as comfort is achieved without causing unnecessary marks on the skin of the wearer.

FIGS. 9–11: CLARIFYING THE WAY THE TAPE T IS TO BE ATTACHED TO THE RIBBON R

Figure 9:
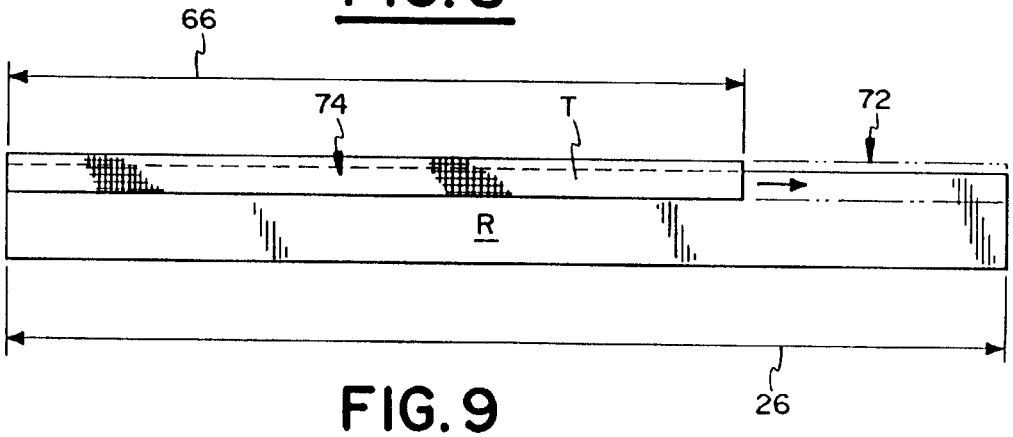
FIG. 9 is a top plan view, of an alternative embodiment, showing the tape in a relaxed condition relative to the ribbon with phantom lines showing the tape's stretched condition.
Figure 10:
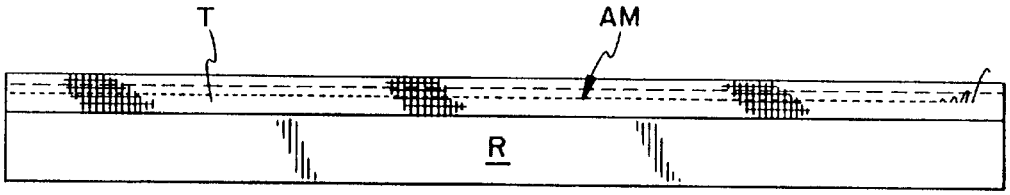
FIG. 10 is a top plan view of the tape in a stretched condition relative to the ribbon with the tape being attached to the ribbon.
Figure 11:
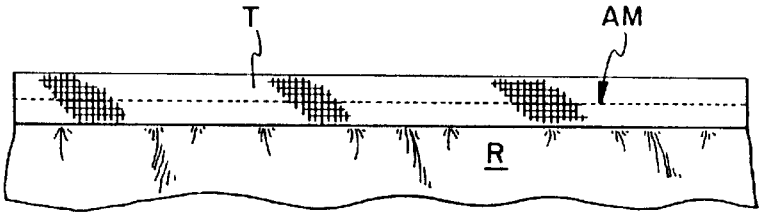
FIG. 11 is a top plan view of the tape in a relaxed condition, but not released, with the ribbon attached thereto.

FIGS. 9–11 show an alternative embodiment and are supplied to clarify the importance of stretching the tape T prior to attaching it to the ribbon R, regardless of any particular relative positioning between the tape T and ribbon R. Note, the tape's T positioning relative to the ribbon R shown in FIGS. 9–11 are not the preferred relative positions disclosed above.

Of course, as discussed above, comfort to the wearer is of the utmost importance and critical when designing sweatbands. Having a sweatband that is too tight is uncomfortable and will also leave a band mark in the skin of the wearer. Likewise, a sweatband that is too loose, is also uncomfortable owing to the fact that the headpiece will wobble on the wearer's head. This invention provides a comfort-fit that is neither too loose nor too tight for a variety of head sizes.

As previously mentioned, the preferred embodiment of this invention allows the tape T to be stretched to a tape-length 66 that is about 25% to 30% greater than the tape-length 66 in the relaxed condition 74.

FIG. 9 displays the tape T, not to scale, in the relaxed condition 74 and placed above and substantially parallel to the ribbon R. It is important to note, the arrow indicates the stretching of the tape T, relative to the ribbon R, whereby the stretched condition 72 is shown by the phantom lines. As can be seen in FIG. 9, the ribbon-length 26 is greater than the tape-length 66 when the tape is in the relaxed condition 74.

FIG. 10 shows the tape T being attached to ribbon R, while the tape T is still in the stretched condition 72. Note, the attachment member AM in this alternative embodiment shown in FIG. 10 is one series of stitches.

FIG. 11 shows the tape T now attached to the ribbon R, whereby the tape T has not been released but has been allowed to return to its relaxed condition 74. While in this position, the ribbon R tends to gather along the tape T. As can be seen in FIG. 11, the ribbon R tends to gather (or form pleats) along the tape T. This is owing to the fact that the ribbon-length 26 is greater than the relaxed condition 74 tape-length 66.

When the sweatband SB is released, the ribbon R will tend to gather in a concaved curved linear fashion with the tape T on the inside of the curve, as can be seen again in FIG. 8.

FIG. 12: CONNECTING THE SWEATBAND SB TO THE HEADPIECE

Figure 12:
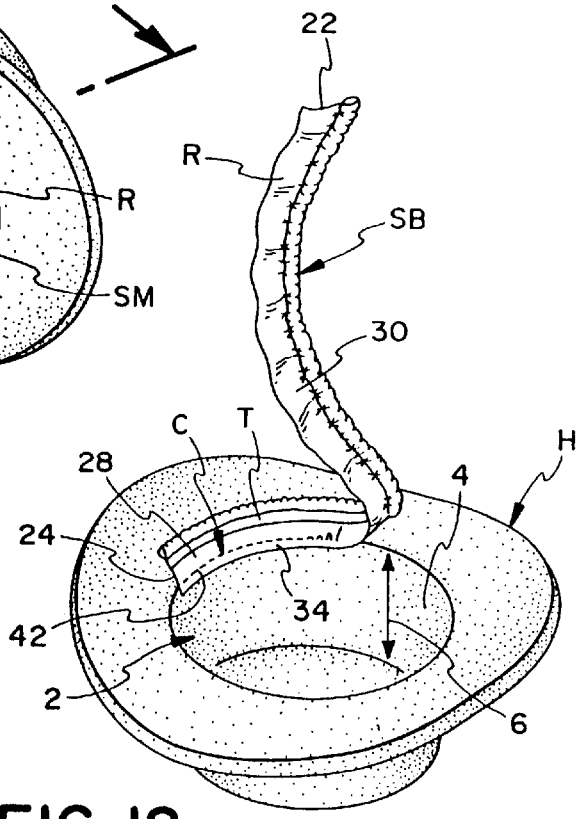
FIG. 12 is an isometric view of the sweatband being attached to the headpiece.

FIG. 12 displays the sweatband SB being connected to the headpiece H. The connecting-fold line 42 spans the ribbon-length 26 and separates the attachment section 32 and the connection section 34. A connecter C is employed along a connecting-fold line 42, so that the lower surface 30 and the connection section 34 of the ribbon R correspond with the interior wall 4 of the headpiece H. The connecter C is preferred to be at least one series stitches as depicted in FIG. 12. The starting point for connecting the sweatband SB to the headpiece H is irrelevant; it can be anywhere within the opening 2. Furthermore, the sweatband SB can be sewn at any depth 6 within the headpiece H. Although, the preferred embodiment is to have the sweatband SB connected near or close to the opening 2 of the headpiece H. Upon connecting the sweatband SB to the headpiece H, the sweatband SB will tend to make the opening 2 narrower.

It is preferred that when the sweatband SB is completely connected around the opening 2 of the headpiece H, that the ribbon's R first end 22 be secured to the ribbon's R second end 24, with a securing member SM (please refer to FIG. 1). It is further preferred that the securing member SM be stitches. Although, it is preferred for the first end 22 and the second end 24 to meet and to be sewn together, it is understood that the first end 22 and the second end 24 may not even meet or they may even overlap.

While it is preferred that the securing member SM and the connecter C be stitches, it is understood that these members (C and SM) could be many other devices such as one or more series of stitches, groups of stitches, gluing, hat tacks, stapling, or any series of two-piece mating systems such as VELCRO (trademark for hook and loop fasteners) or snaps.

FIG. 13

Figure 13:
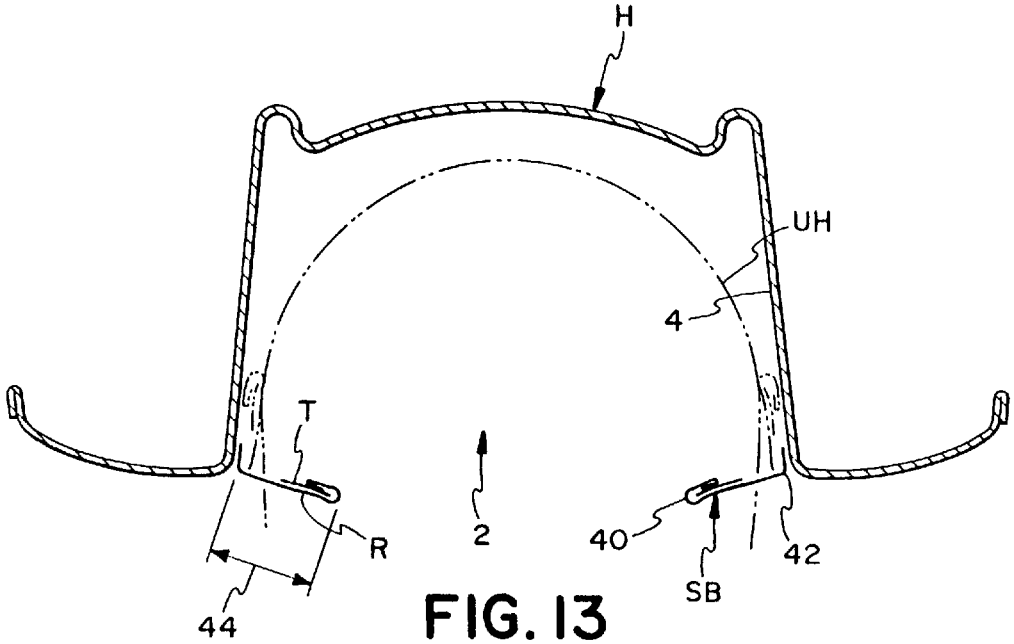
FIG. 13 is a cross-sectional view taken along lines 13—13 of FIG. 1 and showing the sweatband connected to the headpiece as well as in phantom lines showing the user's head deflecting the sweatband.

In FIG. 13, the sweatband SB is shown connected to the headpiece H in a cross-sectional view. In this figure, it can be seen how the sweatband SB tends to narrow the opening 2, by extending towards the center of the opening 2. The elastic tape T is the cause of the extension toward the center of the opening 2.

FIG. 13 also shows, in phantom lines, the headpiece H with the sweatband SB being deflected by a user's head UH. Note how the sweatband SB is being pushed or deflected toward the interior wall 4 by the user's head UH. The elastic tape T is keeping the sweatband SB snugly and comfortably in contact with the user's head.

The contact width 44 of the ribbon R is also shown. This contact width 44 is critical for optimum comfort. Note that the contact width 44 is the linear distance between the connecting-fold line 42 and the second-fold line 40. An appropriate contact width 44 should be between about 0.875 inches and about 1.125 inches. However, a true optimum occurs when the contact width 44 is about 1.0 inches.

While this invention has been described as having a preferred design, it is understood that it is capable of further modifications, uses and/or adaptations of the invention following in general the principle of the invention and including such departures from the present disclosure as come within the known or customary practice in the art to which to invention pertains, and as may be applied to the central features hereinbefore set forth, and fall within the scope of the invention and of the limits of the appended claims.

What is claimed is:

1. A comfort-fit sweatband for a head covering having an interior wall, comprising:

a) a non-elastic ribbon having an attachment section, a connection section for connecting to the interior wall of the head covering, and a ribbon-length, the attachment and connection sections span the ribbon-length;

b) a tape with elastic properties having a stretched-condition, and a relaxed-condition; and, c) an attachment member attaching said tape in the stretched-condition to the attachment section and along the ribbon-length, whereby said ribbon tends to gather in a concave curved linear fashion with said tape on the inside of the curve when the tape is in the relaxed-condition after being attached to said ribbon.

2. A comfort-fit sweatband for a head covering having an interior wall as recited in claim 1, wherein:

a) said attachment member is at least one series of stitches.

3. A comfort-fit sweatband for a head covering having an interior wall as recited in claim 2, wherein:

a) said ribbon further includes a top surface, a bottom surface, a first edge located along the attachment section, first and second folds spanning the ribbon-length and disposed within the attachment section and a connecting-fold spanning the ribbon-length and separating the connection section and the attachment section;

b) said tape further includes a top side, a bottom side, a first tape-ribbon position relationship, whereby said tape is substantially parallel with said ribbon and a portion of the top side corresponds with the bottom surface of the attachment section of said ribbon, and a second tape-ribbon position relationship, whereby said tape is substantially parallel with said ribbon and the bottom side of said tape corresponds with the top surface of the attachment section of said ribbon; and, c) said stitches are stitched along the first-fold when said tape is in the first tape-ribbon position relationship and stitched between said tape and said ribbon when said tape is in the second tape-ribbon position relationship.

4. A comfort-fit sweatband for a head covering having an interior wall as recited in claim 3, wherein:

a) said tape further includes a tape-length, and the elastic properties are such that they allow the tape-length when in the relaxed condition to be extended about 25% to 30% to have a greater value for the tape-length when in the stretched condition.

5. A comfort-fit sweatband for a head covering having an interior wall as recited in claim 4, wherein:

a) said tape has a tape-length in the relaxed condition of about 19 inches and a tape-length in the stretched condition of about 24.5 inches, whereby allowing a comfortable fit for head sizes of about 6⅞ to about 7⅜; and, b) the ribbon-length is about 24.5 inches.

6. A comfort-fit sweatband for a head covering having an interior wall as recited in claim 4, wherein:

a) said tape has a tape-length in the relaxed condition of about 16 inches and a tape-length in the stretched condition of about 21.5 inches, whereby allowing a comfortable fit for head sizes of about 6½ to about 6⅞; and, b) the ribbon-length is about 21.5 inches.

7. A comfort-fit sweatband for a head covering having an interior wall as recited in claim 4, wherein:

a) said tape has a tape-length in the relaxed condition of about 21 inches and a tape-length in the stretched condition of about 26.5 inches, thereby allowing a comfortable fit for head sizes of about 7½ to about 8; and, b) the ribbon-length is about 26.5 inches.

8. A comfort-fit sweatband for a head covering having an interior wall as recited in claim 4, wherein:

a) said tape further includes a width of about 0.375 inches.

9. A comfort-fit sweatband for a head covering having an interior wall as recited in claim 8, wherein:

a) said ribbon further includes a contact width between the connecting-fold and the second-fold, the contact width being about 0.875 inches to about 1.125 inches.

10. A comfort-fit sweatband for a head covering having an interior wall as recited in claim 9, wherein:

a) the contact width is about 1.00 inch.

11. A comfort-fit sweatband for a head covering having an interior wall as recited in claim 10, wherein:

a) said ribbon further includes a ribbon-thickness; and, b) said tape further includes a tape-thickness, a ratio of the tape-thickness to the ribbon-thickness being about 6 to 1.

12. A comfort-fit sweatband for a head covering having an interior wall as recited in claim 11, wherein:

a) the ribbon-thickness is about 0.005 inches; and, b) the tape-thickness is about 0.028 inches.

13. A head covering that adapts comfortably to various head sizes, comprising:

a) a headpiece having an opening and an interior wall;

b) a non-elastic ribbon having an attachment section, a connection section for connecting to the interior wall of the head covering, a connecting-fold, and a ribbon-length, the attachment and connection sections span the ribbon-length and are separated by the connecting-fold;

c) a tape with elastic properties having a stretched-condition and a relaxed-condition;

d) an attachment member attaching said tape in the stretched-condition to the attachment section and along the ribbon-length, whereby said ribbon tends to gather in a concave curved linear fashion with said tape on the inside of the curve when the tape is in the relaxed-condition after being attached to said ribbon; and, e) a connecter located along the connecting-fold of said ribbon connecting the connection section to the interior wall, whereby said ribbon with said tape attached thereto tends to make the opening of the headpiece narrower.

14. A head covering that adapts comfortably to various head sizes as recited in claim 13, wherein:

a) said attachment member is at least one series of stitches.

15. A head covering that adapts comfortably to various head sizes as recited in claim 14, wherein:

a) said ribbon further includes a top surface, a bottom surface, a first edge located along the attachment section, first and second folds spanning the ribbon-length and disposed within the attachment section, and a connecting-fold spanning the ribbon-length and separating the connection section and the attachment section;

b) said tape further includes a top side, a bottom side, a first tape-ribbon position relationship, whereby said tape is substantially parallel with said ribbon and a portion of the top side corresponds with the bottom surface of the attachment section of said ribbon, and a second tape-ribbon position relationship, whereby said tape is substantially parallel with said ribbon and the bottom side of said tape corresponds with the top surface of the attachment section of said ribbon; and, c) said stitches are stitched along the first-fold when said tape is in the first tape-ribbon position relationship and stitched between said tape and said ribbon when said tape is in the second tape-ribbon position relationship.

16. A head covering that adapts comfortably to various head sizes as recited in claim 15, wherein:

a) said tape further includes a tape-length, and the elastic properties are such that they allow the tape-length when in the relaxed condition to be extended about 25% to about 30% to have a greater value for the tape-length when in the stretched condition.

17. A head covering that adapts comfortably to various head sizes as recited in claim 16, wherein:

a) said tape has a tape-length in the relaxed condition of about 19 inches and a tape-length in the stretched condition of about 24.5 inches, thereby allowing a comfortable fit for head sizes of about 6⅞to about 7⅜; and, b) the ribbon-length is about 24.5 inches.

18. A head covering that adapts comfortably to various head sizes as recited in claim 16, wherein:

a) said tape has a tape-length in the relaxed condition of about 16 inches and a tape-length in the stretched condition of about 21.5 inches, thereby allowing a comfortable fit for head sizes of about 6½ to about 6⅞; and, b) the ribbon-length is about 21.5 inches.

19. A head covering that adapts comfortably to various head sizes as recited in claim 16, wherein:

a) said tape has a tape-length in the relaxed condition of about 21 inches and a tape-length in the stretched condition of about 26.5 inches, thereby allowing a comfortable fit for head sizes of about 7½ to about 8; and, b) the ribbon-length is about 26.5 inches.

20. A head covering that adapts comfortably to various head sizes as recited in claim 16, wherein:

a) said tape further includes a width of about 0.375 inches.

21. A head covering that adapts comfortably to various head sizes as recited in claim 20, wherein:

a) said ribbon further includes a contact width between the connecting-fold and the second-fold, the contact width being about 0.875 inches to about 1.125 inches.

22. A head covering that adapts comfortably to various head sizes as recited in claim 21, wherein:

a) the contact width is about 1.00 inch.

23. A head covering that adapts comfortably to various head sizes as recited in claim 22, wherein:

a) said ribbon further includes a ribbon-thickness; and, b) said tape further includes a tape-thickness, a ratio of the tape-thickness to the ribbon-thickness being about 6 to 1.

24. A head covering that adapts comfortably to various head sizes as recited in claim 23, wherein:

a) the ribbon-thickness is about 0.005 inches; and, b) the tape-thickness is about 0.028 inches.

25. A head covering that adapts comfortably to various head sizes as recited in claim 23, wherein:

a) said ribbon further includes a first end and a second end, the first end being secured to the second end when said ribbon is connected to said headpiece, whereby said ribbon with said tape attached is continuous around the opening of said headpiece.

26. A head covering that adapts comfortably to various head sizes as recited in claim 13, wherein:

a) said connecter is at least one series of stitches.

27. A process to provide a head covering that adapts comfortably to various head sizes, comprising the steps of:

a) providing a headpiece having an opening and an interior wall;

b) supplying a non-elastic ribbon having an attachment section, a connection section for connecting to the interior wall of the head covering, a connecting-fold, and a ribbon-length, the attachment and connection sections span the ribbon-length and are separated by the connecting-fold;

c) obtaining a tape with elastic properties having a stretched-condition, and a relaxed-condition;

d) stretching the tape to place the tape in the stretched condition;

e) attaching the tape in the stretched condition to the ribbon along the ribbon-length and in the attachment section; and, f) connecting said ribbon to the interior wall of the headpiece along the connecting-fold.

28. A process to provide a head covering that adapts comfortably to various head sizes as recited in claim 27, wherein:

a) said attaching step is accomplished by at least one series of stitches; and, b) said connecting step is accomplished by at least one series of stitches.

29. A process to provide a head covering that adapts comfortably to various head sizes as recited in claim 28, and further including the steps of:

a) supplying the ribbon with a top surface, a bottom surface, a first edge located along the attachment section, and first and second folds spanning the ribbon-length and within the attachment section;

b) providing the tape with a top side and bottom side;

c) placing the tape in a first tape-ribbon position relationship such that the tape is substantially parallel with the ribbon and a portion of the top side corresponds with the bottom surface of the attachment section of the ribbon;

d) placing the tape in a second tape-ribbon position relationship such that the tape is substantially parallel with the ribbon and the bottom side of the tape corresponds with the top surface of the attachment section of the ribbon; and, e) accomplishing said attaching step by stitching at least one series of stitches along the first fold when the tape is in the first tape-ribbon position relationship and stitching at least one series stitches between the tape and the ribbon when the tape is in the second tape-ribbon position relationship.

30. A process to provide a head covering that adapts comfortably to various head sizes as recited in claim 29, and further including the steps of:

a) providing the tape with a tape-length and elastic properties such that the tape-length when in the relaxed condition may be extended about 25% to about 30% to have a greater value for the tape-length when placed in the stretched condition with said stretching step.

31. A process to provide a head covering that adapts comfortably to various head sizes as recited in claim 30, and further including the steps of:

a) providing the tape with a width of about 0.375 inches; and, b) providing the ribbon with a contact width between the connecting-fold and the second-fold, the contact width being about 0.875 inches to about 1.125 inches, and providing the ribbon with a first end and a second end, and sewing the first end to the second end when the ribbon R is connected to the headpiece, whereby the ribbon R with the tape T attached is continuous around the opening of the headpiece.

32. A process to provide a head covering that adapts comfortably to various head sizes as recited in claim 31, wherein:

a) the contact width is about 1.00 inch.

33. A process to provide a head covering that adapts comfortably to various head sizes as recited in claim 32, and further including the steps of:

a) providing the ribbon with a ribbon-thickness; and b) providing the tape with a tape-thickness wherein a tape-thickness to the ribbon-thickness ratio is about 6 to 1.

34. A process to provide a head covering that adapts comfortably to various head sizes as recited in claim 33, wherein:

a) the ribbon-thickness is about 0.005 inches; and, b) the tape-thickness is about 0.028 inches.

* * * * *

UNITED STATES PATENT AND TRADEMARK OFFICE

CERTIFICATE OF CORRECTION

PATENT NO. : 5,822,799
DATED : October 20, 1998
INVENTOR(S) : Jeffrey L. Kepple

It is certified that error appears in the above-identified patent and that said Letters Patent is hereby corrected as shown below:

Title page,
Change "SWEATING" to -- SWEATBAND --.
Change "COVERING" to -- COVERINGS --.

Column 1,
Line 37, change "users" to -- user's --.

Column 4,
Line 32, insert -- is -- after "edge 36".

Column 6,
Line 33, before "invention", change "to" to -- the --.

Claims,
Claim 5, line 3, change "whereby" to -- thereby --.
Claim 6, line 3, change "whereby" to -- thereby --.

UNITED STATES PATENT AND TRADEMARK OFFICE

CERTIFICATE OF CORRECTION

PATENT NO. : 5,822,799
DATED : October 20, 1998
INVENTOR(S) : Jeffrey L. Kepple

It is certified that error appears in the above-identified patent and that said Letters Patent is hereby corrected as shown below:

Claim 31,subpart b),
Line 6, after "ribbon", delete "R".
Line 7, after "ribbon", delete "R".
Line 7, after "tape", delete "T".

Claim 33, subpart b),
Line 1, after "wherein" change "a" to -- the --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*